United States Patent [19]

Kaplan

[11] 3,940,866

[45] Mar. 2, 1976

[54] SYSTEM FOR MOUNTING THREE DIMENSIONAL LETTERS

[76] Inventor: Louis Kaplan, 67-23 211th St., Bayside, N.Y. 11336

[22] Filed: Apr. 7, 1975

[21] Appl. No.: 565,497

[52] U.S. Cl. ..... 40/142 R; 248/488

[51] Int. Cl.[2] ..... G09F 7/06

[58] Field of Search..... 40/142 R, 140, 141, 143, 40/125 R, 125 E, 125 H, 125 K, 125 F, 133 B, 63 R, 132 D; 248/488

[56] References Cited

UNITED STATES PATENTS

| | | | |
|---|---|---|---|
| 1,002,759 | 9/1911 | Rindge | 248/488 |
| 1,127,895 | 2/1915 | Kahn | 40/142 R |
| 2,916,839 | 12/1959 | Wheaton | 40/143 |
| 3,749,349 | 7/1973 | Kaplan | 248/488 |

FOREIGN PATENTS OR APPLICATIONS

| | | | |
|---|---|---|---|
| 468,435 | 11/1928 | Germany | 40/140 |

*Primary Examiner*—Louis G. Mancene
*Assistant Examiner*—John F. Pitrelli
*Attorney, Agent, or Firm*—Bauer, Amer & King

[57] ABSTRACT

The present invention discloses a system for mounting three dimensional letters on a support surface wherein at least one clip is rigidly secured to the support surface proximate a bottom edge of the letter and at least one other clip is positioned on the support surface proximate a side edge of the letter. Both clips have tongues that engage the respective edges of the letter with at least the clip on the side of the letter having a deformable tongue. With the clips properly secured to the support surface the tongue of the side clip engages the letter, for example in a hole formed therein, and then the letter is forcibly moved downwardly so that the tongue of the bottom clip engages the letter and thereby the letter itself deforms the tongue of the side clip. An obtuse angle is thus generated between the two tongues. Any one of a number of different movable clamping devices, for example such as disclosed in U.S. Pat. No. 3,749,349, may be used at the top of the letter. When the letter is completely mounted, the rear plane thereof is spaced from the front plane of the support surface to permit flow of fluid to the space created in order to wash the front plane of the support surface.

10 Claims, 6 Drawing Figures

FIG. 1
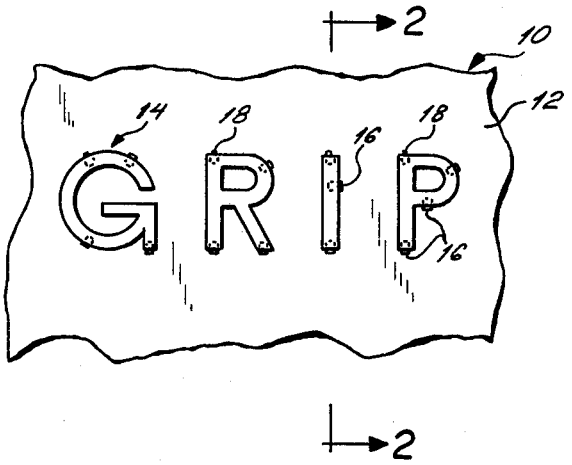
FIG. 2
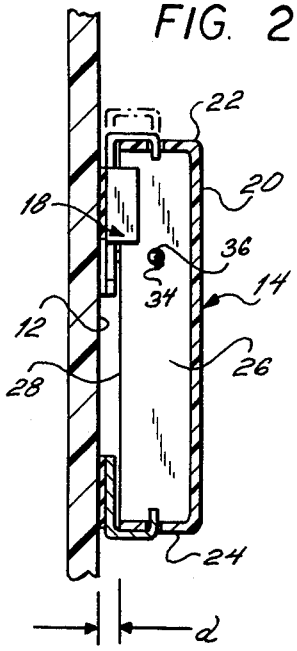
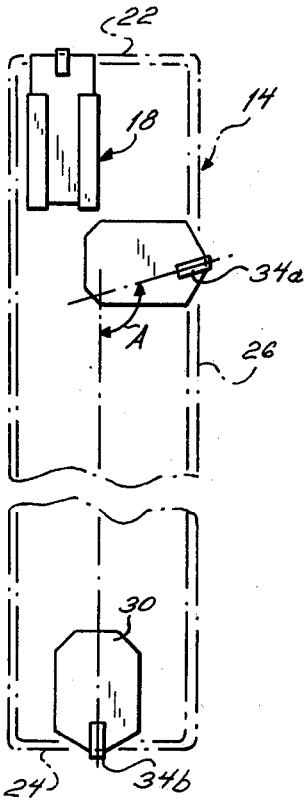
FIG. 3
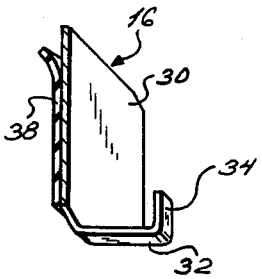
FIG. 4
FIG. 5
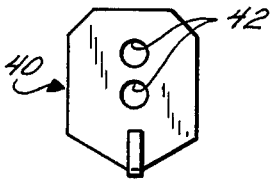
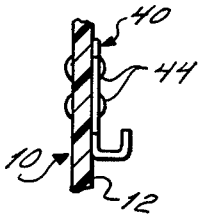
FIG. 6

SYSTEM FOR MOUNTING THREE DIMENSIONAL LETTERS

The aforementioned Abstract is neither intended to define the invention of the application which, of course, is measured by the claims, nor is it intended to be limiting as to the scope of the invention in any way.

BACKGROUND OF THE INVENTION

1. Field of the Invention

This invention relates generally to signs and more particularly to an improved system for mounting individual letters particularly those made of synthetic resin and mounted on a synthetic resin support surface.

2. Description of the Prior Art

There are many systems presently available for mounting letters on a vertical support surface for the purpose of forming a sign. One example of the prior art is shown in U.S. Pat. No. 3,225,477 granted on Dec. 28, 1965 to L. N. Edwards. In this patent the interchangeable letters are provided with brackets secured to the rear faces thereof. The brackets define recesses that can readily accommodate portions of resilient clips. Tangs formed on the rear faces of the brackets extend into openings or recesses in the feet of the resilient clips so that when the resilient clips are inserted into the recesses defined by the brackets on the rear faces of the letters, the tangs on the brackets engage the recesses or openings in the feet of the resilient clips and thereby prevent accidental separation of the clips from the letters. It will be evident from a review of this patent that it is difficult to mount the letters since the brackets are on the rear face thereof and are not visible. Accordingly, in mounting the letters the operator is working in the "blind." This presents considerable difficulty and serves to increase the cost of installation.

U.S. Pat. No. 2,880,537, U.S. Pat. No. 2,916,839 and U.S. Pat. No. 3,142,124 all represent another form of prior art devices that are used in cooperation with individual letters for forming a sign. All of the last three mentioned patents relate to clip-on letters that require some form of groove, aperture or rail for their installation. It will be appreciated that the construction taught by the last three mentioned patents requires a support surface that is relatively expensive to form and which also interferes with rain washing.

Still another form of prior art is shown in U.S. Pat. No. 2,496,747 which utilizes suction cups for retaining individual letters on a vertical surface such as glass. It will be evident that unless the glass is perfectly clean and perfectly flat the suction cups will tend to release the letters and thereby permit them to fall. In addition, atmospheric changes will also adversely affect the continuous operability of the suction cups.

BRIEF DESCRIPTION OF THE INVENTION

The present invention is applicable to three dimensional letters, for example synthetic resin, metal or wood letters that are used to form a sign on a synthetic resin background. In its broadest aspect, the present invention provides at least two clips for each letter with the clip being rigidly secured to the front plane of a vertical support surface. For each letter, one of the clips is positioned proximate the bottom edge of the individual letter while the other clip is positioned proximate one side edge of each individual letter. Preferably each of these two clips includes a tongue which, when they are first installed, are at right angles to each other. The tongues are adapted to engage the letters, for example, in openings that are formed in the respective edges of the letters. At least the clip at the side edge of the letters has a deformable tongue so that when the letters are positioned adjacent the clips, the tongue in the side clip is placed into its respective opening and the letter is moved downwardly so as to deform the tongue prior to the tongue of the bottom clip entering its respective opening in the letter. When fully assembled, the two tongues form an obtuse angle with respect to each other to thereby lock the letter in place. A clamp, for example such as disclosed in my issued U.S. Pat. No. 3,749,349, may be used adjacent the top edge of the letter. The structure disclosed in my aforementioned U.S. patent is incorporated herein by reference.

Accordingly, it is an object of the present invention to provide an improved system for mounting individual letters on a support surface so as to define a sign.

Another object of this invention is to provide improved clip means for mounting individual letters on a support surface.

Still another object of the present invention is to provide an improved system whereby deformable clip means are used for locking individual letters onto a vertical surface so as to define a sign.

An additional object of this invention is to provide an improved system for mounting individual letters on a vertical surface whereby means are included for clamping the letters in place.

It is a feature of the present invention that the clip means used for mounting the letters on the vertical surface automatically space the letters from the vertical surface so as to define a drainage opening for a fluid whereby the vertical surface may be kept clean.

An advantage of the present invention is that the letters may be installed from a position in front of the support surface in a fast, simple manner that minimizes the expenditure of time and money.

A particular object of the present invention is to provide improved means for mounting the clips on the vertical support surface.

These and other features, objects and advantages of the invention will, in part, be pointed out with particularity and will, in part, become obvious from the following more detailed description of the invention taken in conjunction with the accompanying drawing which forms an integral part thereof.

BRIEF DESCRIPTION OF THE DRAWING

In the various figures of the drawing like reference characters designate like parts. In the drawing:

FIG. 1 is an elevational view fragmentarily illustrating a vertical support surface with a plurality of letters mounted thereon in accordance with the concept of this invention;

FIG. 2 is a vertical sectional elevational view, on an enlarged scale, taken along line 2—2 of FIG. 1;

FIG. 3 is an elevational view schematically illustrating the positioning of the clips and clamp means used in the present invention with a typical letter being shown in phantom outline;

FIG. 4 is a perspective view, in cross section illustrating one of the clips of the present invention as well as means for mounting the clip onto a vertical surface;

FIG. 5 is a front elevational view illustrating an alternative embodiment of the clip used with the present invention; and FIG. 6 is a side elevational view of the clip shown in FIG. 5 mounted on a support surface.

DESCRIPTION OF THE PREFERRED EMBODIMENT

Referring first to FIG. 1 there is shown one example of a sign that may be formed by the structure comprising the present invention. A support surface 10 having a front plane 12 is oriented in a vertical direction in the embodiment illustrated. It should be understood however that the support surface 10 need not be vertical. A plurality of letters 14 are mounted on the front surface 12 in spaced relationship thereto by means of a first plurality of clips 16 and a clamping member generally designated by the reference character 18 which may be of the type disclosed in my U.S. Pat. No. 3,749,349 and which is incorporated herein by reference.

As shown by way of example in FIG. 2, each letter 14 is hollow (although it could also be solid), is made of a synthetic resin plastic material (or any other convenient material), and includes a front surface having top, bottom and side edges 22, 24 and 26 extending rearwardly therefrom. The rear plane 28 of the letter 14 is spaced from the front plane 12 of the support surface 10 by the dimension d in order to permit the flow of a fluid such as rain water through the space so as to wash the front surface 12.

As shown best in FIGS. 3 and 4, the clips 16 are each comprised of a base wall 30 having a leg 32 extending outwardly therefrom and a tongue 34 integral with the free end of the leg 32. Initially, the tongue 34 is in a plane parallel to but spaced from the base wall 30. The tongue 34 is adapted to engage an appropriate edge of the letter 14, for example, in an opening 36 formed in the side wall 26 (FIG. 2). It should be understood that the top and bottom walls 22 and 24 have openings similar to the opening 36 in order to receive the tongue 34 of the clip 16 or the clamping member 18 that is mounted adjacent thereto.

In order to mount a letter, the front plane 12 of the support surface 10 is cleaned of any grease or dust and the letters are laid out on the front plane 12. Appropriately located holes 36 are then formed, such as by drilling, in the side, top and bottom edges of each letter 14. The clips 16 are then secured to the front plane 12 by suitable means, for example, by means of a double surface foam plastic tape 38 such as shown in FIG. 4. Initially; the tongues 34 of the clips 16 shown in FIG. 3 will be at right angles to each other. The tongue designated 34*a* in FIG. 3 is then inserted into the hole 36 formed in the side edge 26 of the letter 14 and then the letter 14 is moved downwardly so that the tongue designated 34*b* in the bottom edge 24 in FIG. 3 engages its respective hole 36. In so doing, an obtuse angle A will then be formed between the tongues 34*a* and 34*b* so as to lock the letter 14 in place. The clamping member 18, which has been previously secured to the front plane 12 of the support surface 10 in the open condition, is then released in the usual manner so as to clamp the letter 14 in place. The letter 14 is permanently installed but can be quickly removed for maintenance thereto or to the front place 12 of the support surface 10.

An alternative embodiment of the present invention is shown in FIGS. 5 and 6. A clip 40 is formed with two holes 42 but in all other respects is the same as the clip 16 and need not be further described. Suitable fastener means such as rivets, screws or the like which are generally designated by the reference character 44 may then be used to secure the clip 40 to the support surface 10 in the manner described hereinabove in connection with the first embodiment.

While a specific clamping member, such as disclosed in my issued U.S. Pat. No. 3,749,349 has been suggested for use with the aforementioned clips, it should be clearly understood that this was done by way of illustrative example only and that the invention is not so limited. Other clamping members could be used with equal facility. For example, there could be a two-part swivel mount wherein a first portion is secured to the background support and a second portion pivots into frictional engagement with the first portion. Alternatively the two-part clamping member could employ linear movement and interfitting means for retention. The clamping member could be tempered to spring-like consistency or a separate biasing member such as a torsion spring could be used that urges one portion of the clamping member relative to another portion. This last mentioned embodiment would therefore act in the manner of a spring biased hinge.

From the foregoing it will be appreciated that a low cost simple installation for three dimensional or raised letters has been provided. The clips are inexpensively made from aluminum, stainless steel, plastic or the like. The letters are permanently installed from in front of the support surface. The letters can be easily removed for maintenance to either the letter or the support surface. The system described hereinabove for mounting letters on a support panel takes into account the expansion and contraction of the letters and the support surface due to changes in temperature either exterior or interior. Since the letters are spaced from the support surface, fluid can be passed between the letters and the support surface in order to maintain the support surface in a clean condition.

There has been disclosed heretofore, the best embodiment of the invention presently contemplated. It is to be understood however that various changes and modifications may be made thereto by those skilled in the art without departing from the spirit of the invention.

What I claim as new and desire to secure by Letters Patent is:

1. A system for mounting three dimensional letters on a support surface, said system comprising:

a. at least two clips mounted on the support surface, a first of said clips being positioned adjacent a bottom edge of each letter with a second of said clips being positioned adjacent a side edge of each letter, each said clip including a base wall and a tongue extending therefrom for engaging the letter, said tongues of said first and second clips being initially at approximately a right angle with respect to each other, said tongue of at least said second clip being deformable whereby when the letter is mounted on the support surface, said tongues of said first and second clip form an obtuse angle with respect to each other to thereby lock the letter in place;

b. means for rigidly securing said first and second clips to the support surface; and c. a movable clamping member mounted on the support surface for engaging the top edge of each letter.

2. The system according to claim 1 wherein said clamping member comprises a compound clip including a first section that is rigidly secured to the support surface and a second section that is movable with respect to said first section, said second section including means for engaging a letter to thereby clamp and retain the letter.

3. The system according to claim 2 wherein means are provided for resiliently biasing said second section relative to said first section.

4. The system according to claim 1 wherein said securing means comprises double-sided tape.

5. The system according to claim 1 wherein said securing means comprises fasteners that extend through said clip means and the support surface.

6. The system according to claim 5 wherein said fasteners are rivets.

7. The system according to claim 5 wherein said fasteners are screws.

8. The system according to claim 1 wherein at least a portion of said two clips is positioned between the rear plane of the letter and the front opposing plane of the support surface to thereby define a drain channel.

9. The sign system according to claim 1 wherein each of the letters includes a hole on each edge thereof that is adjacent each said clip whereby said tongue of each said clip is arranged to engage the respective hole therefor.

10. The sign system according to claim 1 wherein there are further included a plurality of consecutive numerals from 0 to 9.

* * * * *